US005509469A

United States Patent [19]

Obosu

[11] Patent Number: 5,509,469

[45] Date of Patent: Apr. 23, 1996

[54] INTERRUPTED FIN FOR HEAT EXCHANGER

[75] Inventor: Charles B. Obosu, Nashville, Tenn.

[73] Assignee: Inter-City Products Corporation (USA), LaVergne, Tenn.

[21] Appl. No.: 229,628

[22] Filed: Apr. 19, 1994

[51] Int. Cl.[6] ..... F28F 1/32

[52] U.S. Cl. ..... 165/151; 165/182

[58] Field of Search ..... 165/151, 182

[56] References Cited

U.S. PATENT DOCUMENTS

| | | | |
|---|---|---|---|
| 3,135,320 | 6/1964 | Forgó | 165/151 |
| 3,759,050 | 9/1973 | Slaasted et al. . | |
| 4,300,629 | 11/1981 | Hatada et al. | 165/151 |
| 4,365,667 | 12/1982 | Hatada et al. . | |
| 4,434,844 | 3/1984 | Sakitani et al. . | |
| 4,469,167 | 9/1984 | Itoh et al. . | |
| 4,480,684 | 11/1984 | Onishi et al. . | |
| 4,580,624 | 4/1986 | Ishida et al. . | |
| 4,691,768 | 9/1987 | Obosu . | |
| 4,705,105 | 11/1987 | Cur . | |
| 4,923,002 | 5/1990 | Haussmann . | |
| 5,062,475 | 11/1991 | Bemisderfer et al. . | |
| 5,099,914 | 3/1992 | Reifel . | |

FOREIGN PATENT DOCUMENTS

| | | | |
|---|---|---|---|
| 57-192794 | 11/1982 | Japan . | |
| 58-158495 | 9/1983 | Japan | 165/151 |
| 60-216188 | 10/1985 | Japan . | |
| 61-243291 | 10/1986 | Japan | 165/151 |
| 62-9197 | 1/1987 | Japan | 165/151 |
| 62-175590 | 8/1987 | Japan . | |
| 62-194194 | 8/1987 | Japan . | |
| 1-305297 | 12/1989 | Japan . | |

*Primary Examiner*—Allen J. Flanigan
*Attorney, Agent, or Firm*—Baker & Daniels

[57] ABSTRACT

The present invention involves a flat fin heat exchanger configuration with a plurality of louvers and a rib raised above the plane of the fin connecting adjacent tube collars. The raised rib configuration enhances the heat transfer characteristics of the fin, and allows for the use of thinner materials to lower cost without diminishing performance. The exterior fin surface "scoops" and redirects air flow from the leading edge to the trailing edge of the fin. This "scooping" effect directs the air flow over and in between the interrupted surfaces, thus breaking up air boundary layer around the fin. The louvers of the fin are oriented relative to the air flow in such a manner that each louver in effect creates another leading edge contributing to a higher heat transfer coefficient. Also, the location of the raised rib also enhances the heat transfer between the fin and the circulated air. The fin collars are also surrounded by a raised portion so that one raised rib and its two adjacent raised portions bordering the collar form a "dog bone" type shape. The leading and trailing edges are serrated to improve the structural rigidity and create turbulence in the air flow. Also, the leading and trailing edges are oriented at a slight angle, e.g., 12°, relative to the plane of the fin. The louvers are oriented at a slightly greater angle than the leading and trailing edges, e.g., 20°–35°.

26 Claims, 3 Drawing Sheets

INTERRUPTED FIN FOR HEAT EXCHANGER

BACKGROUND OF THE INVENTION

1. Field of the Invention

The present invention relates to heat exchangers. More specifically, the field of the invention is that of fin geometries for use in conjunction with heat exchanger tubes.

2. Description of the Related Art

Heat exchangers are used in air conditioners and heat pumps to transfer energy between two fluid mediums, e.g., a refrigerant fluid and ordinary air. The refrigerant fluid is circulated through relatively small diameter tubes and air is passed over the surface of the tubes so that heat may be transferred from the refrigerant fluid, through the material of the heat exchanger tube, to the air. Thin metal sheets, or fins, are attached to the heat exchanger tubes to provide a greater amount of surface area to contact the air and thereby enhance the heat transfer. The fins include receiving apertures so that the metal material of the fins is securely held in thermal contact with the material of the tubes. By the forced convection caused by the fan system, heat is transferred from the fin material to the circulating air. By the thermal contact with the tubes, the fins conduct heat between the externally circulating and air and the refrigerant fluid in the heat exchanger tubes.

To enhance the transfer of heat through the fins between the air and the refrigerant fluid, the fins have surface enhancements that accentuate the turbulence and mixing of the air around the heat exchanger. For example, the inventor's previous U.S. Pat. No. 4,691,768, entitled "LANCED FIN CONDENSER FOR CENTRAL AIR CONDITIONER", assigned to the assignee of the present invention, the disclosure of which is incorporated by reference, discloses one such enhanced fin design. In this design, the fins are generally corrugated and have locally parallel pairs of lanced bridge-like formations which increase flow turbulence and flow mixing. However, such corrugated designs are more difficult to manufacture than flat plate designs.

Other corrugated fin designs also provide improvements in the heat exchange efficiency of fins. One prior art design involves louvered convolutions with staggered rows of tube holes being located on the ridges of the convolutions. Another prior art design involves a fin having three sets of offset, inclined louvers above and below the fin plate. Yet another prior art design involves a radially symmetric fin design for bi-directional air flow. Other prior art fin designs call for troughs and crests for enhancing heat transfer, stepped louvers, louvers of unequal length, and fins with a corrugated surface having local air guidance profiles.

A flat plate design which provides heat transfer characteristics similar to that of the enhanced corrugated type design is shown in FIGS. 1 and 2. Fin 20 is made of thin sheet metal, approximately 0.0044 inches thick, and has a nine section louver arrangement between adjacent heat exchanger tube collars 22. The fins of the heat exchanger are separated by the height of collar 22, with the top of one fin collar abutting the bottom of the adjacent fin collar. The nine section arrangement shown in FIGS. 1 and 2 may be efficiently manufactured in a one step enhancement station within the overall die stamping process. This type of design has gained widespread acceptance because the heat transfer efficiency of the fin is comparable to that of other enhanced corrugated fins, relatively easy to manufacture, and structurally sound.

Fin 20 includes outer edge louvered portions 24 which have outer portions extending in a plane generally coincident with the plane of fin 20. The interior facing portions of edges 24 are bent downwardly in the direction of center element 26 which is located in the middle of fin 20. The middle of center element 26 is generally disposed in the plane of fin 20 and its edges are bent upwardly. Three louvers 28 are disposed between center element 26 and edges 24. Louvers 28 are generally disposed at an angle in the range of 23° to 27° relative to the plane generally defined by fin 20, with their center axes being generally coplanar with the plane of fin 20. Also, the outer most louvers 28 are divided in half by flat portions 30, with additional flat portions 32 extending around collars 22 and to the outer edges of fin 20 to separate groups of louvers 28.

These fin structures are required to be both cost effective and efficient. However, often a more efficient design proves to be more expensive in terms of materials and/or manufacturing. Conversely, relatively simple designs tend to be less desirable because of inferior heat transfer characteristics. Therefore, a more efficient and economically viable heat exchanger fin design is desired. Also, it is desirable to minimize material costs by using thinner sheet metal, as conventional designs are already made with sheet metal which is as thin as practical.

SUMMARY OF THE INVENTION

The present invention involves a flat fin heat exchanger configuration with a plurality of louvers and a rib raised above the plane of the fin connecting adjacent tube collars. The raised rib configuration enhances the heat transfer characteristics of the fin, and allows for the use of thinner materials to lower cost while maintaining the structural integrity of the fin.

The configuration of the present invention provides an exterior fin surface which "scoops" and redirects air flow from the leading edge to the trailing edge of the fin. Heat transfer coefficients are higher near or at the leading edge of a fin surface. This "scooping" effect directs the air flow over and in between the interrupted surfaces, thus breaking up air boundary layer around the fin. The louvers of the fin are oriented relative to the air flow in such a manner that each louver in effect creates another leading edge contributing to a higher heat transfer coefficient of the fin.

Also, the location of the raised rib also enhances the heat transfer between the fin and the circulated air. The raised rib further provides the fin with additional structural integrity that allows for the use of a reduced material thickness. The process of raising the ribs of the fin stiffens the material of the ribs, and secures the louvered portions of the fin between the collars. In fact, the fin collars are also surrounded by a raised portion so that one raised rib and its two adjacent raised portions bordering the collar form a "dog bone" type shape. This "dog bone" feature extends across the length of the fin, strengthening the louvered structure.

The "dog bone" feature provides an additional advantage when used in a fin for an evaporator. In an evaporator, often humid air is circulated about the cooler heat exchanger coils, causing the formation of condensate on the relatively cool coils. The raised ribs serve as a wick in drawing off condensate from the fins. This capillary attraction of the condensate tends to remove moisture from the louvered surface. By removing condensate from the louvers and gaps of the fin, the pressure drop across the heat exchanger is minimized, thus increasing the heat transfer efficiency. The present invention is particularly applicable to a heat pump wherein either the indoor or outdoor heat exchanger coil may operate as an evaporator.

The leading and trailing edges of the fin are also specially designed to enhance the strength and performance of the heat exchanger. The leading and trailing edges are serrated to improve the structural rigidity and create turbulence in the air flow. Also, the leading and trailing edges are oriented at a slight angle, e.g., 12°, relative to the plane of the fin. Those edges break up the air boundary layer and direct the turbulated air to the louvered portions for further mixing.

The louvers are oriented at a slightly greater angle than the leading and trailing edges, e.g., 20°–35°, to further break up the air flow and restart several leading edges. The configuration of the present invention also allows for a greater number of louvers to be formed on the same fin stock thickness in order to increase the heat transfer rate of the fin. Also, by having the center rib extend out of the plane of the fin, the rib interacts with the flowing air to a greater extent than if it was located in the plane of the fin.

Another advantage of the present invention is that the fin configuration may be formed in a single stage tool enhancement station in the overall fin die, thus lowering the cost of manufacture. The ability to use a thinner material aides in reducing material costs as well. The configuration of the present invention reduces the amount of material in the fin by as much as 15%, which is a significant cost savings considering that aluminum is typically the material of the fin.

The present invention, in one form, is a heat exchanger having at least one heat exchanger coil and a generally planar fin. The heat exchanger coil includes a plurality of tubes for containing a circulating refrigerant fluid. The fin includes a plurality of collars each of which define an aperture that engages a tube. The fin also includes a plurality of louvers disposed between adjacent collars. The louvers extend at an angle with respect to the plane of the fin. The fin further includes a raised rib extending out of the plane of said fin between adjacent ones of said collars.

One advantage of the present invention is to provide a more efficient and economically viable heat exchanger fin design.

Another advantage of the invention involves minimizing material costs by using thinner sheet metal while maintaining the structural integrity of the fin.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
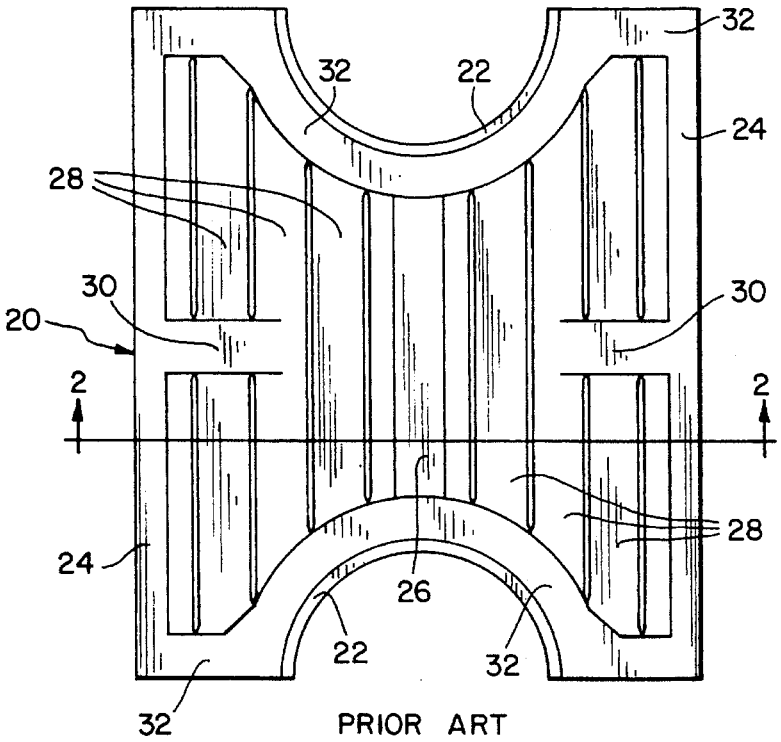
PRIOR ART FIG. 1
FIG. 1 is a top plan view of a prior art fin structure.
Figure 2:
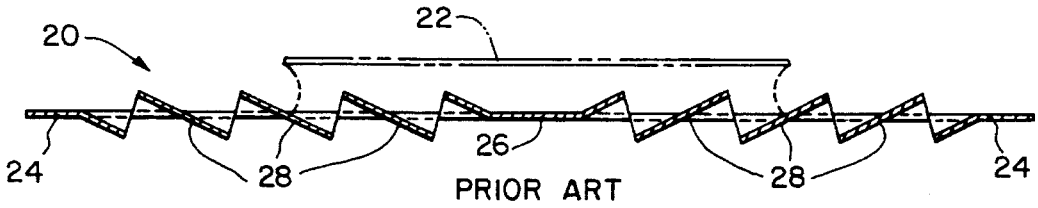
PRIOR ART FIG. 2
FIG. 2 is a cross-sectional view taken along view line 2—2 of FIG. 1.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates preferred embodiments of the invention, in several forms, and such exemplifications are not to be construed as limiting the scope of the invention in any manner.

DESCRIPTION OF THE PREFERRED EMBODIMENTS

The preferred embodiments disclosed below are not intended to be exhaustive or limit the invention to the precise forms disclosed in the following detailed description. Rather, the embodiments are chosen and described so that others skilled in the art may utilize their teachings.

Figure 3:
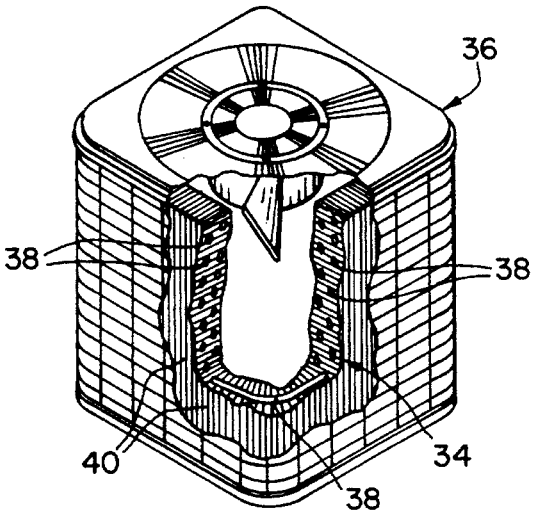
FIG. 3 is a perspective view, in partial cut-away, of a typical central air conditioning system utilizing a finned heat exchanger.

The present invention relates to heat exchanger 34 of central air conditioning unit 36, which is depicted in FIG. 3. Typically, heat exchanger 34 operates as a condenser in a central air conditioning system and includes one or two rows of heat exchanger coils formed into rectangular or circular shapes. The fin structure must be structurally rigid to withstand the bend radius required for such shapes, which may be 5 inches or more. However, a structure similar to heat exchanger 34 may be used in an evaporator or a condenser, and may be located in the outdoor or indoor unit of the air conditioning or heat pump system. For example, the indoor side of a heat pump or air conditioner may include a conventional A-frame configuration heat exchanger with three or four rows of heat exchanger coils. So while heat exchanger 34 may be characterized as a condenser in the description below, the structure of heat exchanger 34 may be applied to other applications as well.

Heat exchanger 34 includes one or a series of fluidly connected heat exchanger tubes 38 which are in thermal contact with a plurality of fins 40. Fins 40 are generally closely spaced apart and serve as thermal conduits between the refrigerant fluid in tubes 38 and the air which circulates over fins 40 because of the action of fan 42. FIGS. 4–11 show four different embodiments of fins 40 made in accordance with the present invention. Each of the embodiments has a generally planar fin body and a plurality of louvers formed out of the planar fin body in a single stage enhancement die pressing action in the overall fin die.

In accordance with the present invention, each fin has a raised rib extending between adjacent heat exchanger tubes. Taking the embodiment of FIGS. 4 and 5, for example, fin body 44 includes edge portions 46, louvers 48, and centrally disposed raised rib 50. The center points of edge portions 46 and louvers 48 generally define plane 52 of fin body 44, and raised rib 50 extends out of and above plane 52. Raised rib 50 extends between adjacent collars 54 which define tube apertures 56. Raised rings 58 extend around collars 54 at about the same level as raised rib 50 out of and above plane 52. Thus, the series of raised ribs 50 and raised rings 58 provides a backbone for fin body 44.

The arrangement of fin body 44 has a "scooping" effect on air which flows over the heat exchanger. Plane 52 is generally disposed parallel to the direction of air flow, and edge portions 46 and louvers 48 direct the air over and between the interrupted surfaces of fin body 44, preventing the development of boundary layers along the generally planar segments comprising fin body 44. This type of turbulence starts at the leading edge 60 and continues past the trailing edge 60 on the other side of fin body 44. Heat transfer coefficients are higher near or at the leading edge of a surface which develops a boundary layer, so the arrangement of those edges and the louvers creates several leading edges which start their own boundary layers and thus enhance the heat transfer.

In addition, rib 50 advantageously extends out of and above plane 52 so that air which is turbulated by the louvers has a greater amount of interaction with rib 50. Alternatively, rib 50 may extend out of and below plane 52 to achieve a similar effect. The arrangement of rib 50 tends to have a lesser pressure drop than conventional designs when operating as an evaporator. Rib 50 tends to serve as a wick to draw off moisture, e.g., by capillary attraction in addition to gravity, thus further improving the efficiency of the invention when used as an evaporator.

A further advantage of rib 50 extending out of plane 52 involves the strength of fin body 44. The process of pressing raised rib 50 out of plane 52 creates a reinforcing structure which enhances the integrity of fin body 44. This allows the louvers to be formed without significant bending or warping of fin body 44. By the structure of the present invention, material costs for fin body 44 may be reduced by up to fifteen percent (15%) over the conventional design.

Figure 4:
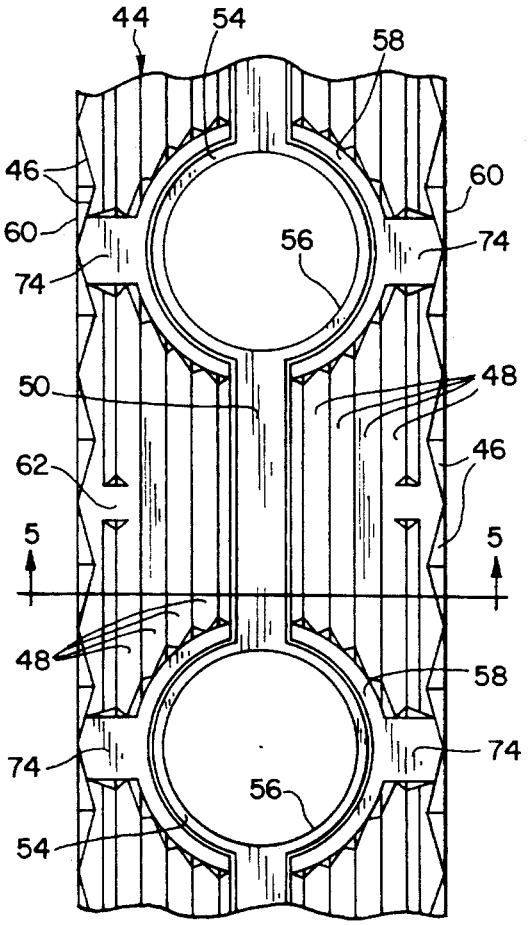
FIG. 4 is a top plan view of a first embodiment of the present invention.
Figure 5:
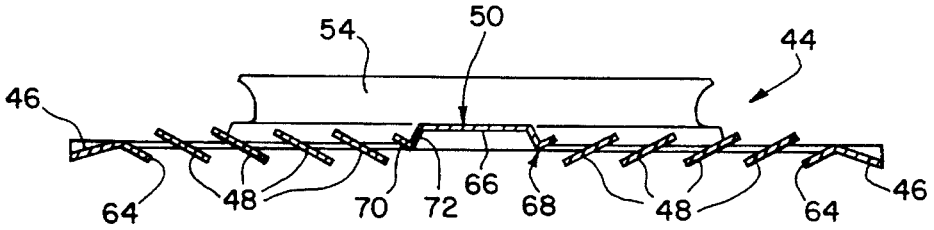
FIG. 5 is a cross-sectional view taken along view line 5—5 of FIG. 4.

The embodiment of FIGS. 4 and 5 is an 11 element design with equally spaced louvers 48. Edge portions 46 are serrated at outer edge 60, and disposed at an angle relative to plane 52 in the range of 5° to 15°, preferably about 12°. The four louvers 48 on either side of raised rib 50 are disposed at an angle relative to plane 52 in the range of 20° to 35°, preferably about 28°. Outer edge 60 is inclined in the opposite angular direction from that of louvers 48. The outer louvers are split into two halves by base portion 62 of fin body 44. Inner portions 64 of edge portions 46 are inclined with respect to plane 52 at about the same angle as the adjacent ones of louvers 48. Also, the arrangement of edge portions 46 and louvers 48 is symmetrical around raised rib 50.

Raised rib 50 comprises central, generally flat portion 66 which is bordered by angled edges 68. Outer portion 70 of angled edge 68 is oriented at about the same angle as its adjacent louver 48, and inner portion 72 extends transversely between flat portion 66 and outer portion 70. Flat portion 66, in the preferred embodiment, is disposed in a plane about 0.010 to 0.015 inches above plane 52. Approaching collar 54, flat portion 66 merges with raised ring 58. The combination of one flat portion 66 with its two adjacent raised rings 58 forms the "dog bone" feature which is the backbone of the structure of fin body 44. The "dog bone" extends above plane 52, which includes the centers of louvers 48 and planar separating portions 74 between longitudinally adjacent groupings of louvers 48. Also, the raised structure of rib 50 acts as a wick to draw off condensate by capillary attraction, minimizing the pressure drop across the louvered structure.

Figure 6:
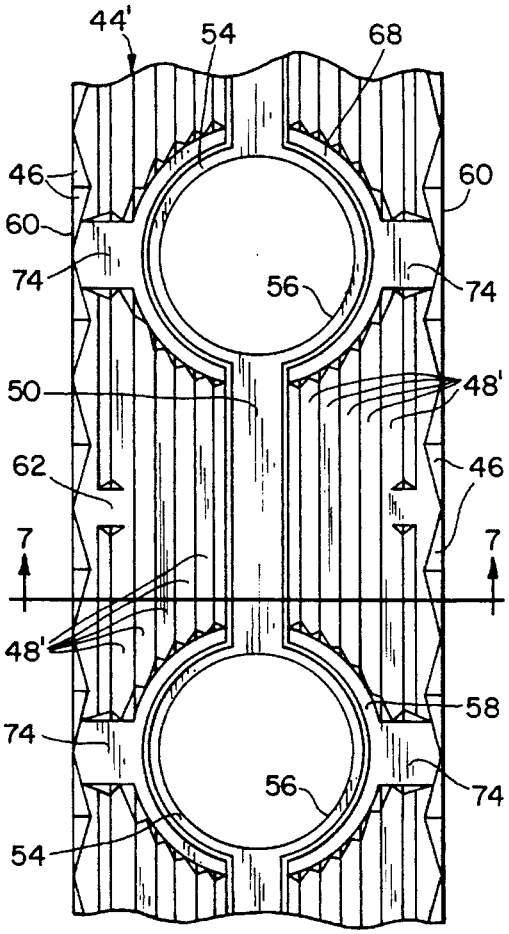
FIG. 6 is a top plan view of a second embodiment of the present invention.
Figure 7:
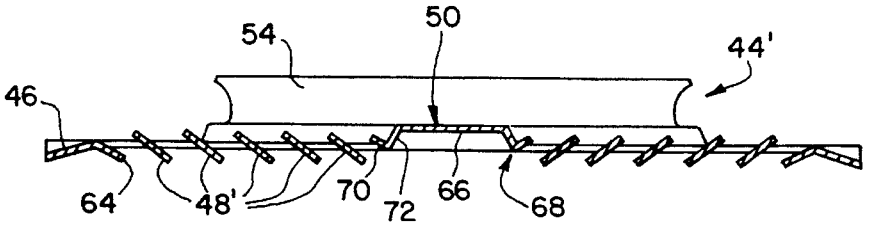
FIG. 7 is cross-sectional view taken along view line 7—7 of FIG. 6.

FIGS. 6 and 7 show a second embodiment of the invention comprising a 13 element design with equally spaced louvers 48'. The configuration and orientation of the embodiment of FIGS. 6 and 7 are similar to that of the embodiment of FIGS. 4 and 5, with the exception of the greater number of louvers 48', each having a smaller width. FIGS. 4–7 show embodiments of the invention wherein the louvers have an equal width. In the preferred embodiment of FIGS. 4 and 5, each louver 48 has a width of approximately 0.062 inches. In the preferred embodiment of FIGS. 7 and 8, each louver 48' has a width of approximately 0.053 inches. In each of the first and second embodiments, fin body 44 has a total width of approximately 0.866 inches.

Figure 8:
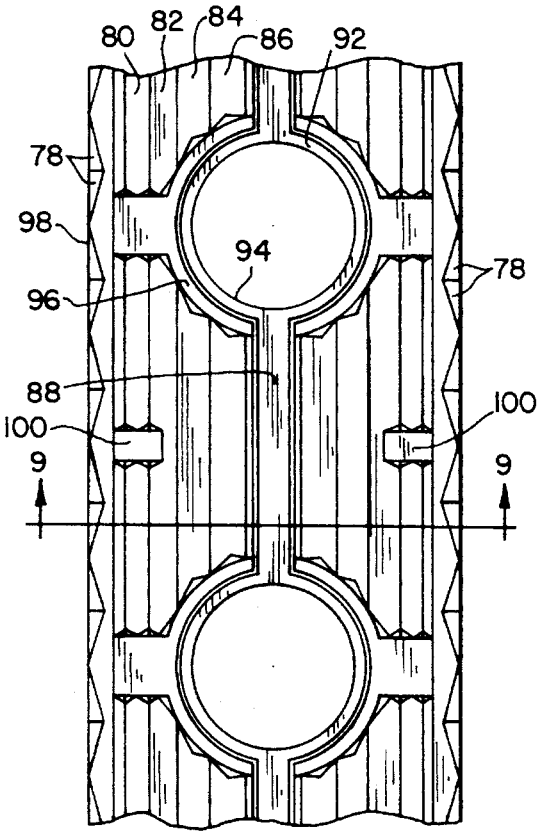
FIG. 8 is a top plan view of a third embodiment of the present invention.
Figure 9:
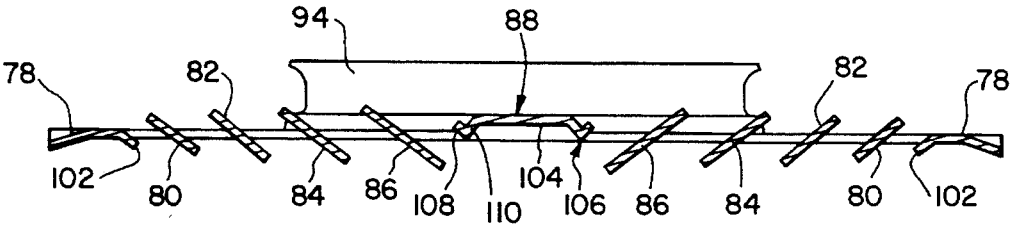
FIG. 9 is a cross-sectional view taken along view line 9—9 of FIG. 8.

Alternatively, FIGS. 8–11 show embodiments of the invention wherein the louvers have a varying, progressive width. FIGS. 8 and 9 show a third embodiment of the invention comprising an 11 element design with progressive louvers. Fin body 76 includes edge portions 78, louvers 80, 82, 84, 86, and centrally disposed raised rib 88. The center points of edge portions 78 and the louvers generally define plane 90 of fin body 76, and raised rib 88 extends above plane 90. Raised rib 88 extends between adjacent collars 92 which define tube apertures 94. Raised rings 96 extend around collars 92 at about the same level as raised rib 88 above plane 90. Thus, the series of raised ribs 88 and raised rings 96 provides a backbone for fin body 76.

The embodiment of FIGS. 8 and 9 is an 11 element design with louvers which become progressively wider going from edge portion 78 to rib 88. Edge portions 78 are serrated at outer edge 98, and disposed at an angle relative to plane 90 in the range of 5° to 15°, preferably about 12°. Louvers 80, 82, 84, and 86 on either side of raised rib 88 are disposed at an angle relative to plane 90 in the range of 20° to 35°, preferably about 25°. Outer louvers 80 and 82 are split into two halves by base portion 100 of fin body 76. Inner portions 102 of edge portions 78 are inclined with respect to plane 90 at about the same angle as the adjacent louvers 80. Also, the arrangement of edge portions 78 and louvers 80, 82, 84, and 86 is symmetrical around raised rib 88.

Raised rib 88 comprises central, generally flat portion 104 which is bordered by angled edges 106. Outer portion 108 of angled edge 106 is oriented at about the same angle as its adjacent louver 86, and inner portion 110 extends transversely between flat portion 104 and outer portion 108. Flat portion 104, in the preferred embodiment, is disposed in a plane about 0.01 inches above plane 90. Approaching collar 92, flat portion 104 merges with raised ring 96. The combination of one flat portion 104 with its two adjacent raised rings 96 forms the "dog bone" feature which is the backbone of the structure of fin body 76. The "dog bone" extends above plane 90, which includes the centers of louvers 80, 82, 84, 86, and planar separating portions 112 between longitudinally adjacent groupings of louvers 80, 82, 84, and 86.

Figure 10:
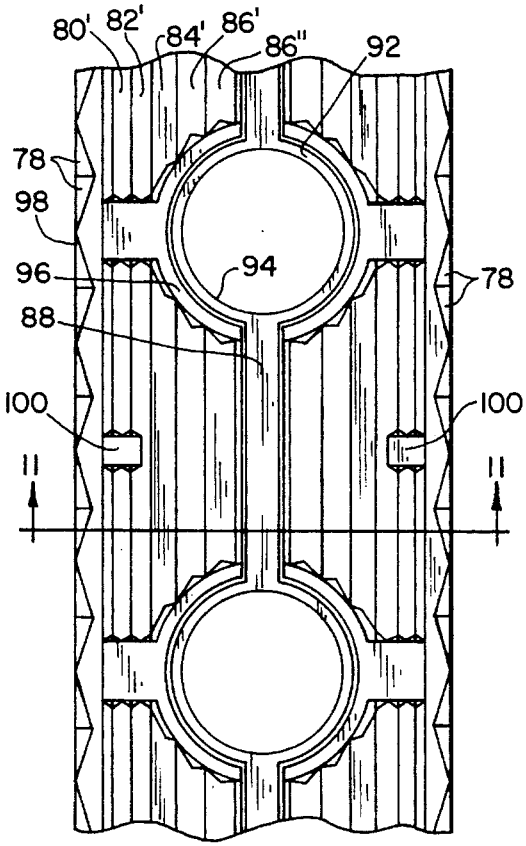
FIG. 10 is a top plan view of a fourth embodiment of the present invention.
Figure 11:
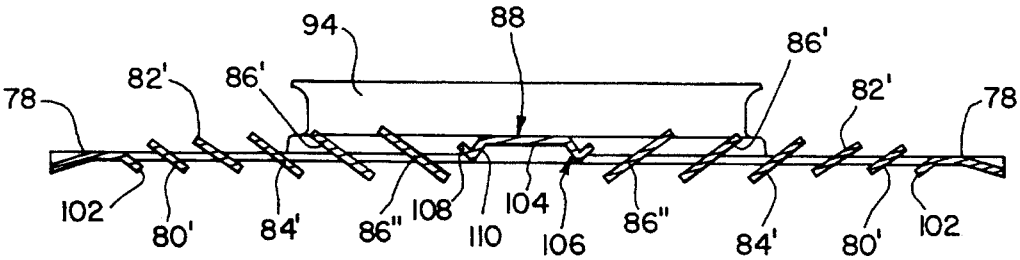
FIG. 11 is a cross-sectional view taken along view line 11—11 of FIG. 10.

FIGS. 10 and 11 show a forth embodiment of the invention comprising a 13 element design with progressively wider louvers 80', 82', 84', 86', and 86". The configuration and orientation of the embodiment of FIGS. 10 and 11 are similar to that of the embodiment of FIGS. 8 and 9, with the exception of the greater number of louvers, each having a smaller width. In the preferred embodiment of FIGS. 8 and 9, louver 80 has a width of approximately 0.051 inches, louver 82 has a width of approximately 0.060 inches, louver 84 has a width of approximately 0.069 inches, and louver 86 has a width of approximately 0.078 inches. In the preferred embodiment of FIGS. 10 and 11, louver 80' has a width of approximately 0.043 inches, louver 82' has a width of approximately 0.051 inches, louver 84' has a width of approximately 0.058 inches, louver 86' has a width of approximately 0.066 inches, and louver 86" has a width of approximately 0074 inches.

In any of the disclosed embodiments, the fins are manufactured out of a roll of stock metal material. Preferably, the fin material comprises an aluminum alloy and temper, such as 1100-H111. Other suitable materials include copper, brass, qupro nickel, and material with similar properties. The configuration of the fin body is formed in a one step enhancement die stage process to form the required louver and rib structure. The edge trim, and cutting to appropriate fin length, are done at subsequent stages of the overall die. The stock material is cut according to the number of rows in the heat exchanger. For example, a typical outdoor side heat exchanger may only have one or two single row coils, while a typical indoor side heat exchanger may have two, three, or four rows of coils. The single row arrangement, shown in the drawings for ease of understanding, may be applied to multiple row designs. For multiple row designs, the stock material is not cut between rows so that the edge portions which are adjacent to other edge portions are not physically severed. Once the fin stock is appropriately formed, the heat exchanger tubes are inserted into the fin apertures and their ends are connected to form the heat exchanger coils. The ends of the coils are then suitably connected to the refrigerant lines of the air conditioning or heat pump system.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A heat exchanger comprising:

at least one heat exchanger coil with a plurality of tubes, said tubes for containing a circulating refrigerant fluid; and a generally planar fin including a plurality of collars each of which define an aperture, said apertures engaging said tubes, said fin including a plurality of louvers, said louvers disposed between adjacent ones of said collars, said louvers extending at an angle with respect to the plane of said fin, said fin including a flat raised rib extending out of and generally parallel to the plane of said fin between adjacent ones of said collars.

2. The heat exchanger of claim 1 wherein said fin has edges disposed at an angle relative to the plane of said fin.

3. The heat exchanger of claim 1 wherein said fin includes circular raised portions disposed around said collars, said circular raised portions extending out of the plane of said fin.

4. The heat exchanger of claim 1 wherein said louvers are symmetrically disposed about said raised rib.

5. The heat exchanger of claim 1 wherein said raised rib extends about 0.010 to 0.015 inches out of the plane of said fin.

6. The heat exchanger of claim 5 wherein said fin includes circular raised portions disposed around said collars, said circular raised portions extending about 0.010 to 0.015 inches out of the plane of said fin.

7. The heat exchanger of claim 1 wherein said fin includes edge portions adjacent to one of said louvers, said edge portions extending at an angle relative to the general plane of said fin.

8. The heat exchanger of claim 7 wherein said edge portions extend at an opposite angular direction to the angle of the adjacent one of said louvers.

9. The heat exchanger of claim 7 wherein said edge portion includes an outer portion and an inner portion relative to said rib, said outer portion extending at an opposite angular direction to the angle of the adjacent one of said louvers, said inner portion extending at in the same angular direction to the angle of the adjacent one of said louvers.

10. The heat exchanger of claim 1 wherein said louvers have approximately equal widths.

11. The heat exchanger of claim 1 wherein said louvers have varying widths.

12. The heat exchanger of claim 11 wherein the width of each of said louvers progressively increases from an outer portion of said fin to said rib.

13. The heat exchanger of claim 1 wherein said raised rib draws off condensate from said fin whereby the pressure drop across said heat exchanger is minimized.

14. A heat exchanger comprising:

a plurality of heat exchanger coils having tubes, said tubes for containing a circulating refrigerant fluid; and a generally planar fin including a plurality of collar: each of which define an aperture, said apertures engaging said tubes, said fin including a plurality of rows defined by said apertures, each said row including a heat exchanger coil and a plurality of louvers, said louvers disposed between adjacent ones of said collars, said louvers extending at an angle with respect to the plane of said fin, said fin including a flat raised rib extending out of and generally parallel to the plane of said fin between adjacent ones of said collars.

15. The heat exchanger of claim 14 wherein said fin has edges disposed at an angle relative to the plane of said fin.

16. The heat exchanger of claim 14 wherein said fin includes circular raised portions disposed around said collars, said circular raised portions extending out of the general plane of said fin.

17. The heat exchanger of claim 14 wherein said louvers of each said row are symmetrically disposed about said raised rib.

18. The heat exchanger of claim 14 wherein said raised rib extends about 0.010 to 0.015 inches out of the plane of said fin.

19. The heat exchanger of claim 18 wherein said fin includes circular raised portions disposed around said collars, said circular raised portions extending about 0.010 to 0.015 inches above the plane of said fin.

20. The heat exchanger of claim 14 wherein each said row of said fin includes edge portions adjacent to one of said louvers, said edge portions extending at an angle relative to the plane of said fin.

21. The heat exchanger of claim 20 wherein said edge portions extend at an opposite angular direction to the angle of the adjacent one of said louvers.

22. The heat exchanger of claim 20 wherein said edge portion includes an outer portion and an inner portion relative to said rib, said outer portion extending at an opposite angular direction to the angle of the adjacent one of said louvers, said inner portion extending in the same angular direction to the angle of the adjacent one of said louvers.

23. The heat exchanger of claim 14 wherein said louvers have approximately equal widths.

24. The heat exchanger of claim 14 wherein said louvers have varying widths.

25. The heat exchanger of claim 24 wherein the width of each of said louvers progressively increases from an outer portion of each said row to said rib.

26. The heat exchanger of claim 14 wherein said raised rib draws off condensate from said fin whereby the pressure drop across said heat exchanger is minimized.

* * * * *